United States Patent [19]

Seiler

[11] 4,221,931

[45] Sep. 9, 1980

[54] TIME DIVISION MULTIPLIED SPEECH SCRAMBLER

[75] Inventor: Norman C. Seiler, West Melbourne, Fla.

[73] Assignee: Harris Corporation, Cleveland, Ohio

[21] Appl. No.: 843,032

[22] Filed: Oct. 17, 1977

[51] Int. Cl.[2] ..... H04K 1/04; H04K 1/06

[52] U.S. Cl. ..... 179/1.5 R; 178/22; 179/1.5 S

[58] Field of Search ..... 179/1.5 S, 1.5 R; 178/22; 325/32

[56] References Cited

U.S. PATENT DOCUMENTS

| | | | |
|---|---|---|---|
| 2,405,500 | 8/1946 | Guanella | 179/1.5 S |
| 3,201,517 | 8/1965 | Gannett | 179/1.5 R |
| 3,717,206 | 2/1973 | Zopf et al. | 325/32 |
| 3,824,467 | 7/1974 | French | 179/1.5 S |
| 3,921,151 | 11/1975 | Guanella | 179/1.5 S |
| 4,087,626 | 5/1978 | Brader | 178/22 |
| 4,149,035 | 4/1979 | Fuitiger | 179/1.5 R |

*Primary Examiner*—Howard A. Birmiel
*Attorney, Agent, or Firm*—Craig & Antonelli

[57] ABSTRACT

A privacy communication system in which increased security is provided in the scrambling of speech signals. Input speech is separated into a high frequency band and a low frequency band, and each band is time scrambled independently and recombined prior to transmission. Additional security is obtained with randomly selected segments of the scrambled speech being reversed in time. Further randomizing of the pseudorandom sequence which controls the scrambling operation is also provided, as well as simplified computing of delay times for the descrambling operation.

28 Claims, 14 Drawing Figures

SPEECH SCRAMBLER

SPEECH DESCRAMBLER

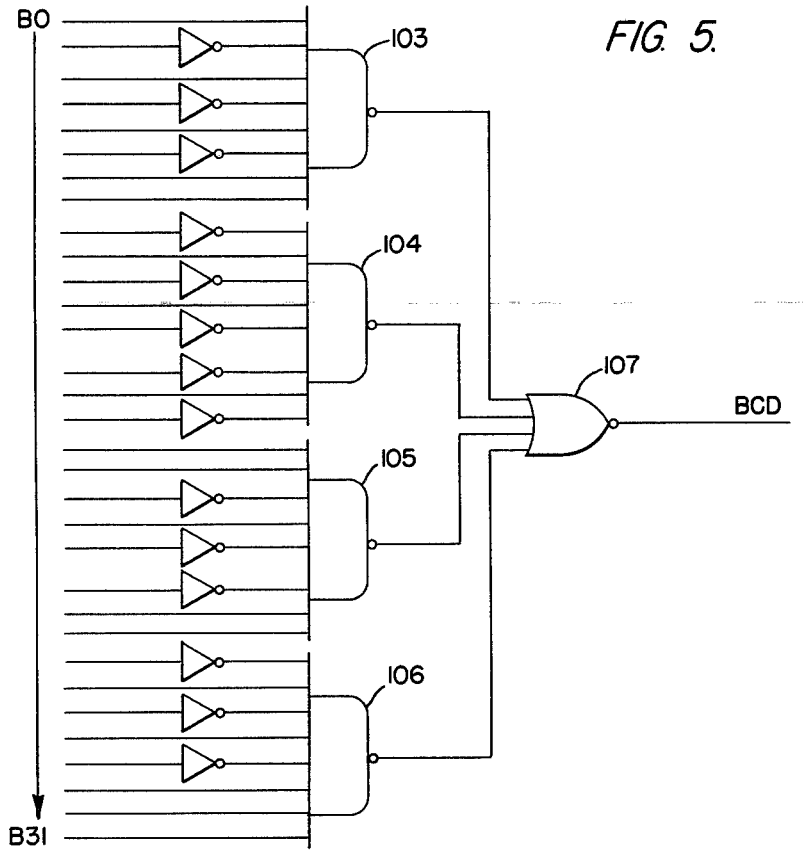
FIG. 5.
FIG. 7.
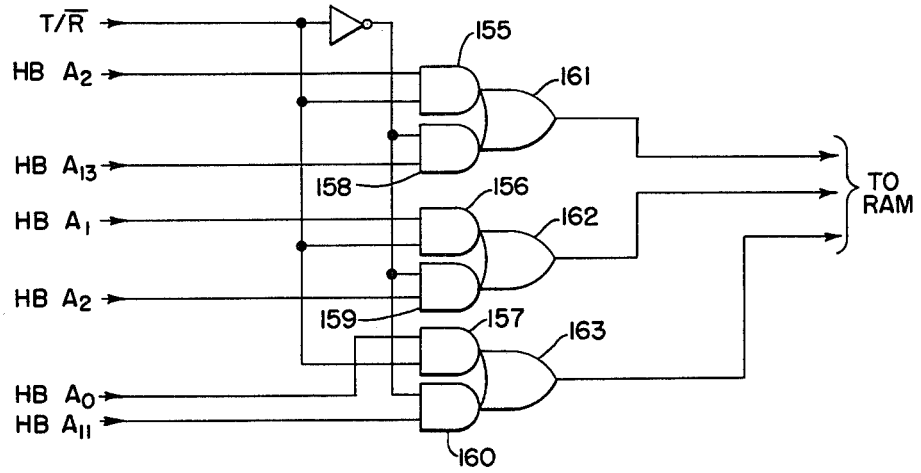

HIGH BAND DELAY COMPUTER
TO DE-SCRAMBLER 84
LOAD-SHIFT
B0
B1
B2
B3
B4
B5
B6
B7
B8
B9
B10
B11
B12
B13
B/D CONV.
198
190
191
192
193
194
195
196
197
171
172
173
174
175
176
177
178
CNTR.
181
182
183
184
185
186
187
188
200B
200A
199B
199A
FF
COMPUTE
256KHZ
B/D CONV.
170
HB A0
HB A1
HB A2

TIME DIVISION MULTIPLIED SPEECH SCRAMBLER

BACKGROUND OF THE INVENTION

1. Field of the Invention

The present invention relates to privacy transmission systems in which a communication is rendered unintelligible so that its transmission will be unavailable to unauthorized third persons, the communication being capable of being unscrambled after reception by an authorized person to recover the original intelligence.

2. Description of the Prior Art

Communication systems have been developed which serve to prevent unauthorized persons from intercepting and acquiring the transmitted intelligence communicated therefrom. These systems are based upon a pseudorandom scrambling of the speech signals prior to transmission so as to render the transmission unintelligible and therefore, secure with respect to unauthorized third parties who may intercept the transmission.

Voice communications can be made more secure, or more private, if the speech is mixed with a random process similar to noise; however, the random process cannot be truly random, but must be capable of reproduction, so that the scrambled speech can be descrambled. The mixing may be by multiplication, which results in a signal whose spectrum is determined by the random process, or may be accomplished by shifting segments or blocks of the speech in time, in a random manner. Unfortunately, the former type of system has been found to be disadvantageous in that it requires a rather wide bandwidth; whereas, in the latter type of system, the resulting signal can be made to have the same spectrum as the original speech, a very desirable property, since the scrambled speech will not be confined to radio transmission but can then be sent over telephone lines as well.

A system for providing time division multiplexing of clear speech in order to provide scrambled speech capable of being transmitted with privacy has been disclosed in U.S. Pat. No. 3,824,467, issued July 16, 1974, to Richard Charles French. In the patented system, a plurality of memory segments are randomly addressed by a pseudorandom number generator, and the addressed segments serve to record digital information corresponding to the current time segment of speech while simultaneously recovering stored digital information corresponding to a previous time segment of speech. The scrambled voice segments are descrambled by determining the amount by which each segment has been delayed in the scrambler and then further delaying each segment so that the total delay of each segment of speech, including both the scrambling and unscrambling delays, will be equal.

Another type of system is disclosed in U.S. Pat. No. 3,921,151, issued Nov. 1, 1975, to Gustav Guanella. In this system, an information signal divided into equal time intervals, the individual signal elements being applied in the received sequence to a memory for temporary storage. Each of the stored elements is then read out in a random pattern so as to scramble the arrangement of the elements as compared with their original received arrangement in which they have been stored. The process is effectively reversed at the receiving end to descramble the signal elements.

In spite of the various different privacy systems which have been provided hereinbefore, it has been found that the simple transposition of signal elements provides insufficient security against deciphering, particularly in the case where only a single scrambling of the elements is effected during the reading out of the contents of a memory in which the signal elements have been stored in the order in which they were received. In addition, the conventional pseudorandom number generators heretofore used fail to reduce the periodicity of the generated sequences sufficiently to provide the degree of security required for adequate privacy.

It is therefore a principal object of the present invention to provide a narrow band privacy transmission system having the ability to transmit scrambled voice frequency signals with increased security.

It is another object of the present invention to provide an improved narrow band privacy transmission system of the type wherein blocks or segments of speech are shifted in time in a random manner to effect scrambling of the speech, the scrambling and unscrambling operations being effected automatically in a simplified manner with greater security.

It is a further object of the present invention to provide a system of the type described in which the random nature of the scrambling of speech is materially increased to reduce the periodicity of the generated sequences.

SUMMARY OF THE INVENTION

According to the present invention, there is provided a privacy transmission system for the transmission of voice frequency signals of the type in which voice communication signals are divided into segments or blocks and the segments of speech are shifted in time in a random manner both at the time of initial storage and at the time of transmission. In addition, with the present invention, the scrambling process is made more secure by separating the input speech into a high frequency band and a low frequency band, each band being time scrambled independently. Further security is also obtained by reversing in time randomly selected blocks of the scrambled speech in the upper and lower bands, that is, by transmitting the selected block or segment backwards. The scrambled signal, consisting of random time scrambling of upper and lower speech bands and random reversals, is subjected to an inverse process to recover the input speech.

The time scrambling process, and the reversing process, consists of subjecting the speech signal to varying degrees of delay within a predetermined limit. The delay function is implemented most easily on digital data, and therefore, the speech signal, after being filtered into respective high and low frequency bands, is digitized. The two resultant digital speech signals are stored in memory to perform the delay function by selective addressing of the memory blocks in a pseudorandom manner. Blocks or segments of data, each one consisting of selected elements of digital speech, are read from the memories in an order which is random with respect to the order in which it was written, the reading and writing being under control of a pseudonoise sequence, which possesses the appropriate random properties.

Selected blocks or segments are read out in the reverse order in which they were written, thus causing those data segments to be reversed in time. The selection of the reversed blocks or segments is also under control of the pseudonoise sequence generator. The data sequences read out of the two memories are reconverted to linear signals, representing two bands of scrambled speech. These are then combined into one signal, for transmission.

In descrambling a received transmission, the received scrambled speech is again filtered into upper and lower bands and converted to digital data. The digitized scrambled speech is placed in memory and is read out in blocks or segments, the write and read sequences being generated so that the total time in storage, both in the scrambler and in the descrambler, is constant. For this purpose, the descrambler includes a pseudonoise sequence generator identical to that provided in the scrambler and logic to compute the storage times for a constant total delay for each segment. Also, those blocks or segments which were reversed in the scrambler will again be automatically reversed in the descrambler under control of the pseudonoise sequence, the two reversals serving to cancel each other. The two digital data channels read from the memories are again reconverted to linear signals and combined. The result is descrambled speech, also delayed typically by the predetermined time period similar to that in the scrambler.

In addition to the increased security provided by scrambling the digitized speech in separate high and low band channels and then mixing the channels prior to transmission, the pseudorandom sequence on which scrambling is based can be further randomized in accordance with this invention. This is accomplished by providing a long pseudorandom sequence generator to generate the basic random sequence which is then used to control respective short pseudorandom sequence generators associated with the respective high and low band memories. Thus, the scrambling operation in the respective channels will be based on different sequences of addresses. Further, the outputs of the short pseudorandom generators are selectively mixed will outputs of the long pseudorandom sequence generator to further randomize the scrambling operation.

A further feature of the present invention resides in the simplicity in which descrambling is effected. In this regard the delay accorded the scrambling segments in storage within the respective memories of the two channels is computed for each segment by counters which run until reset by receipt of a segment address. The state of the counters, when reset, represent the delay afforded each segment during the scrambling operation. The additional delay required to equalize the delay of each segment is then simply obtained by inverting the states of the respective counters.

These and other objects, features, and advantages of the present invention will become more apparent from the following detailed description of an exemplary embodiment, when taken in conjunction with the accompanying drawings.

BRIEF DESCRIPTION OF THE DRAWINGS

FIG. 5 is a schematic circuit diagram of the Barker code detector;

FIG. 7 is a schematic circuit diagram of a portion of the segment select circuit.

DESCRIPTION OF THE PREFERRED EMBODIMENTS

Figure 1A:
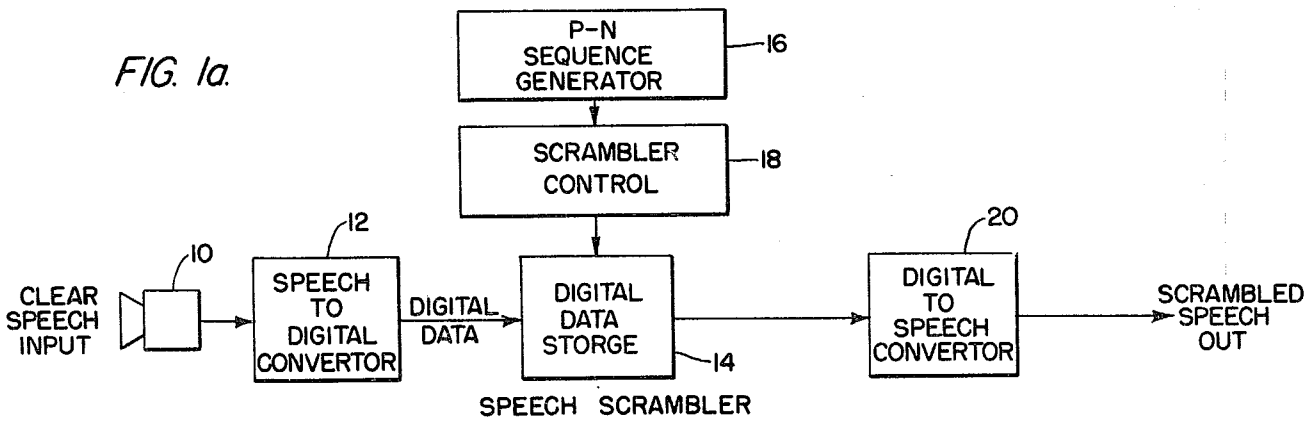
FIG. 1*a* is a functional block diagram of the speech scrambler in accordance with this invention.

FIG. 1 represents a functional block diagram of the digital speech scrambler in accordance with the present invention. Clear speech is received by a transducer 10, such as a microphone, and is converted to voice frequency signals. Since the storage of data is most easily accomplished if it is in a digital format, the output of the transducer 10 is supplied to a speech-to-digital converter 12 which serves to digitize the voice frequency signals. the digital data provided at the output of the converter 12 is then supplied to a digital data storage or memory 14 which serves to hold segments or blocks of the speech signals for selected delay periods of variable duration, thereby shifting the segments or blocks of speech in time in a random manner.

A pseudonoise sequence generator 16 provides random digital words, each one representing a delay instruction, to a scrambler control circuit 18 which receives the sequence of random delay instructions from the generator 16 and converts them to sequences of memory addresses which control the accessing of memory blocks in the digital data storage 14. The data read out of the storage 14 is then supplied through a digital-to-speech converter 20 to convert the digital signals to linear speech (scrambled) signals.

In accordance with the present invention, the speech scrambler as seen in FIG. 1*a* will in fact include two channels, both controlled from the output of the scrambler control 18 in response to the random delay instructions provided by the generator 16. One of the channels will serve to scramble the high frequency portion of the speech, while the other channel will scramble the low frequency portions of the speech. By separately processing the high frequency and low frequency components of the speech signal, each band is time-scrambled independently to greatly increase the security of the scrambling process. In addition, as will be described in greater detail hereinafter, further security in the scrambling process is obtained in randomly selected blocks or segments of the scrambled speech (upper or lower band) are reversed in time, that is, transmitted backwards.

Figure 1B:
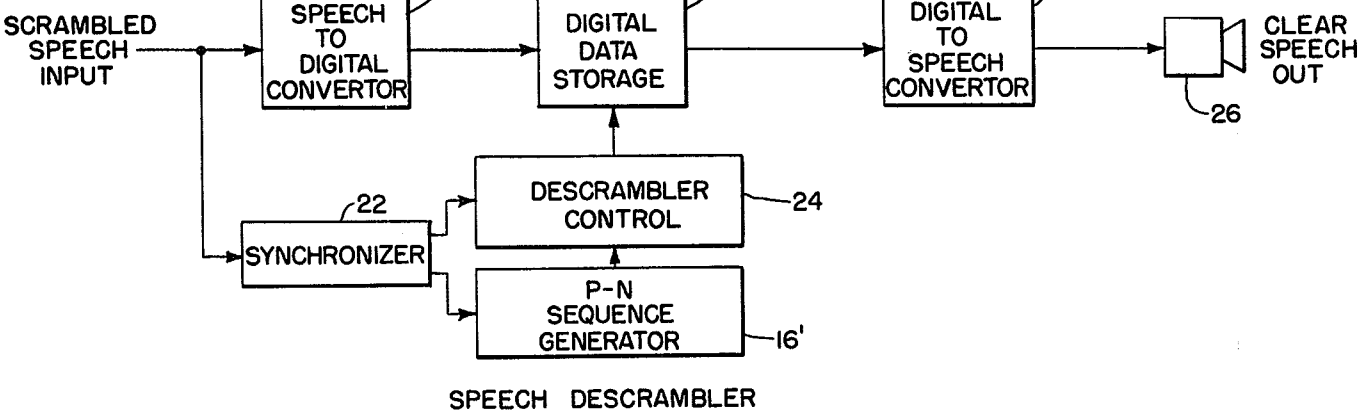
FIG. 1*b* is a functional block diagram of the speech descrambler in accordance with this invention.

FIG. 1*b* shows a functional block diagram of the speech descrambler in accordance with the present invention. Most of the elements of the scrambler are reproduced in the descrambler and are identified in the figure by the same reference numeral with the addition of a prime (′). Scrambled speech is received at the speech-to-digital converter 12′ where it is converted to digital format for storage in the digital data storage 14′. A synchronizer 22 is included in the speech descrambler to cause the descrambler to begin its operation at the beginning of the received scrambled message and therefore synchronize itself with the operation of the speech scrambler. In this regard, preceding each scrambled speech message there will be provided a synchronizing signal consisting of a synchronizing zone, a fixed pattern with good correlation properties, and the contents of the sequence generator in the speech scrambler at the beginning of the scrambling operation. The synchronizer 22 will therefore preset the sequence generator 16' to the value received at the beginning of the scrambled speech message so that the generator 16' can control the descrambler control 24 to reproduce the sequence of memory addresses which resulted in the scrambling of the speech signals in the speech scrambler. As the digital data storage 14' is addressed, data is read out to the digital-to-speech converter 20' which converts the digital signals to linear voice frequency signals to be applied to the transducer 26, which produces clear speech.

Contrary to what may be indicated from FIGS. 1*a* and 1*b*, separate channels for speech scrambling and speech descrambling need not be provided. In actual practice, a single system for providing speech scrambling and descrambling will share common elements such as the speech-to-digital converters, the digital data storage and the pseudonoise sequence generators. Simple switching between scrambling and descrambling can then provide a simplified system using common control of elements which are shared for the scrambling and descrambling functions. An exemplary embodiment of the present invention, which is illustrated in FIG. 2, will clearly show such an integrated system.

Figure 2:
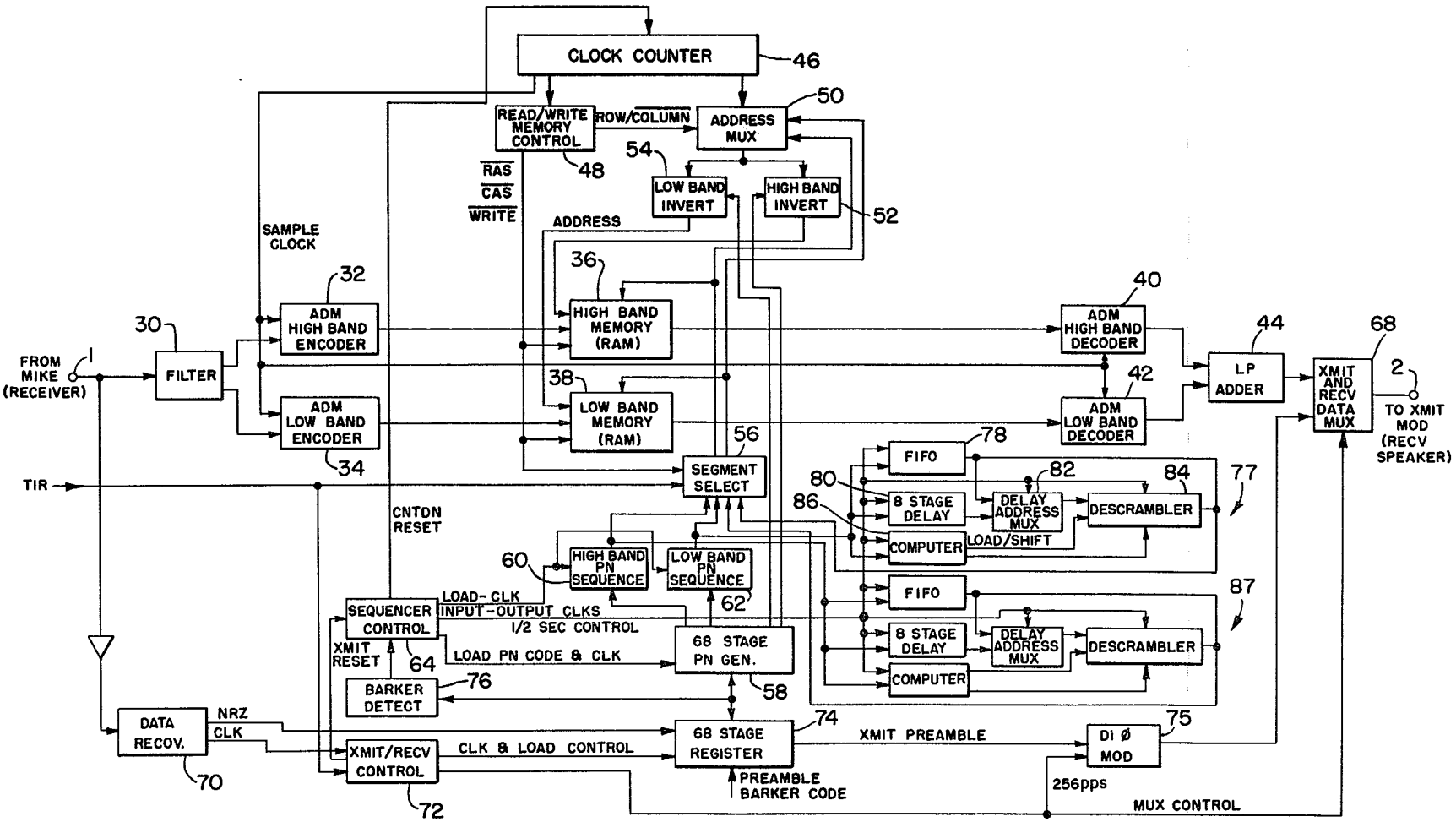
FIG. 2 is a schematic block diagram of a preferred embodiment.

Referring to FIG. 2, voice frequency signals, representing clear speech derived from the output of a transducer, or a scrambled transmission obtained at the output of a communication receiver, is received at input terminal 1 and applied to a high pass-low pass filter 30. The filter 30 serves to separate linear electrical signals representing speech into a high frequency band and a low frequency band. In this regard, one of the characteristic features of the present invention resides in the fact that the input speech is separated into respective frequency bands which are time-scrambled independently. The high frequency speech band and the low frequency speech band are applied respectively to adaptive delta modulator encoders 32 and 34 where the speech bands are converted to digital format and provided at the output thereof as a serial digital bit stream.

The digital data in the respective high and low frequency channels are stored in separate random access memories 36 and 38, each memory being divided into eight memory segments. The memory addresses within each memory segment are generated sequentially, so that the data stored therein is ordered sequentially, but the segments are addressed randomly. Data is read from the memories 36 and 38 from the same locations into which data is being written, so that the amount of time that one segment of data remains in memory is determined by the time interval between successive addressing of that segment. Since the segment addressing is performed randomly, the segment storage times are also random.

The addressing of the storage locations in each memory segment is performed under control of a clock counter 46, which provides the necessary clock signals to control the timing of the various operations performed within the system to effect scrambling and descrambling of the received speech signals. The random delays applied to the data stored in each memory segment represent a total average delay of the scrambled speech, and, in accordance with the system timing, this delay averages at one-half second. Thus, during each one-half second period of the operating cycle of the system, eight segments of data are stored in each of the memories 36 and 38 while eight segments of data previously stored in these memories are read out at the same time.

The clock counter 46 controls a read/write memory control circuit 48 which is responsive to selected clock signals for generating signals to control the reading and writing operations in connection with the memories 36 and 38, as well as providing the selection signals for column and row, as is well known in memory addressing. An address multiplexer 50 is also responsive to timing signals from the clock counter 46 and to control by the memory control circuit 48 for generating the sequential memory addresses within each segment, which addresses are applied from the multiplexer 50 through a high band invert circuit 52 and a low band invert circuit 54 to the respective memories 36 and 38.

The invert circuits 52 and 54 are selectively controlled to randomly reverse the sequence of addresses for a selected memory segment, causing the data within the segment to appear in reverse order. In this regard, the respective circuits 52 and 54 include a simple switching arrangement which either directly applies the addresses from multiplexer 50 to the memories 36 and 38 or applies these addresses through inverters in response to applied high and low band invert signals.

A sixty-eight stage pseudorandom sequence generator 58 generates a random digital bit stream at the rate of two bits per second, the outputs of which are utilized to randomly select the memory segment addresses for the purpose of scrambling or descrambling the data stored in the memories 36 and 38. This is accomplished in conjunction with two short pseudorandom sequence generators 60 and 62, which each generate an eight bit sequence of sixteen bits per second and are reset every one-half second to random patterns determined by the state of the sequence generator 58. The outputs of the short sequence generators 60 and 62 are further randomized by being mixed with the contents of the long sequence generator 58. The net result is two pseudorandom sequences of three bit words, which randomly sequence through the set of all eight possible states every one-half second, providing the eight memory segment addresses in a random sequence. These memory segment addresses are applied from the output of the short sequence generators 60 and 62 through a segment select circuit 56 to the respective memories 36 and 38.

The outputs from the memories 36 and 38 are decoded to linear signals by respective adaptive delta modulator decoders 40 and 42, and the outputs from the two decoders are summed in an adder circuit 44, the output of which represents either scrambled speech signals or descrambled speech signals. These signals are applied through a transmit and receive data multiplexer 68 to the output terminal 2 for application either to the transmitter modulator or to the receiver speaker, as required.

An advantageous feature of this system resides in the fact that the scrambled speech occupies the same band width as the original speech, since the signals in each segment are unscrambled, and the frequency is generated by the random delaying of the segments or at the lower edge of the speech spectrum. The scrambled speech provided at the output terminal 2 appears one-half second after the scrambling process begins, since this time is required to load the two memories 36 and 38. During this time, a synchronized signal is generated to enable the descrambler to correctly decode the scrambled speech patterns. The synchronizing signal consists of a synchronizing tone, a fixed pattern with good correlation properties, such as a Barker code, and the contents or state of the long pseudorandom sequence generator 58 at the start of the scrambling operation. This synchronizing signal is formulated in a register 74, which receives the Barker code from a suitable source (not shown) and the contents of the generator 58, and forwards this preamble to the transmitted signal through a modulator 75, which adds the synchronizing tone, to the transmit and receive data multiplexer 68 for outputting prior to the outputting of the data stored in the memories 36 and 38. This generation of the synchronizing preamble signal is timed to require on-half second, after which the scrambled speech signals from the memories 36 and 38 appear at the output terminal 2.

The system of FIG. 2 provides not only for scrambling of speech signals for transmission, but also effects descrambling of linear signals representing scrambled speech. First, the linear signals are separated into high and low frequency components by the filter 30 and each component is converted to digital signals through the adaptive delta modulator encoders 32 and 34. The two resultant digital channels are then stored in the memories 36 and 38, organized in segments identical to the scrambler memory organization. In this regard, the synchronizing preamble signal of the transmission is applied through a data recovery circuit 70, connected to the input terminal 1, to the register 74. The data recovery circuit 70 also enables the transmit/receive control circuit 72 to prepare the system for receipt of a transmission and to enable the sequencer control 64 to realign the clock counter 46 in accordance with the received transmission.

The fixed pattern Barker code is applied from the register 74 to a Barker detector 76 which confirms receipt of a proper transmission and enables the sequencer control 64 to effect transfer of the contents of the sequence generator, which forms a part of the preamble from the register 74, into the generator 58. Thus, when synchronized, the pseudorandom sequence generator 58 will generate memory address sequences identical to those produced in the scrambler to effect generation of memory segment addresses through the high band sequencer 60 and low band sequencer 62 which will be applied through segment select circuit 56 to the memories 36 and 38 effecting storage of the segments of digital data being received.

The received speech segments are subjected to delays in the memories 36 and 38 in a manner similar to the scrambling operation; however, in the case of descrambling, the delays are computed to be such that all segments receive the same total delay in both scrambler and descrambler. In this regard, the total delay is one second, and this is made up of the scrambler delay and the descrambler delay. The selective delay of the segment address as required for descrambling is performed under control of the segment delay control circuits 77 and 87, which serve to control generation of segment addresses for reading data out of the memories 36 and 38. The circuits 77 and 87 are similar, and therefore, only one of these circuits will be specifically described.

During the descrambling operation, each scrambled speech segment (in digital format) is stored in a different segment of the respective memories 36 and 38. The segment delay control circuits 77 and 87 compute when the storage speech segments should be retrieved from the memory, so as to subject the segments to the required delays necessary for descrambling. In this regard, upon receipt of a transmission, the pseudorandom sequence generator 58 is loaded from that portion of the synchronizer signal preceding the transmission which represents the contents of the scrambler pseudorandom sequence generator at the beginning of the scrambling operation. As the descrambler sequence generator 58 is in the same state as was the scrambler sequence generator at the beginning of the scrambling operation, it will generate the same pseudorandom sequence as that generated by the scrambler sequence generator. These segment addresses are applied to a first-in-first-out (FIFO) circuit 78 as well as to an eight stage delay circuit 80 and a delay computer 86 in the segment delay control circuit 77.

The FIFO circuit 78 is capable of storing eight segment addresses in sequence and of applying these addresses to the segment select circuit 56 from the output thereof in the order in which they were received to control the storage of data in the memories 36. While the addresses are being applied to and circulated in the FIFO 78, the computer 86 computes the delay required for each segment to effect descrambling of the data upon retrieval from the memory 36. After the sequence of eight addresses required for data storage has been generated by the sequencers 58 and 60 for the high band, a following sequence of eight addresses in a random order will be generated for data retrieval. The computer 86 will calculate the delay between receipt of the same address in the two sequences and determine the additional delay required to make the total delay equal to one full second for all segments. While the computer 86 is performing this computation, the second sequence of addresses is delayed in the delay circuit 80.

The delay address multiplexer 82 applies the addresses after an eight bit delay in delay circuit 80 to a descrambler 84, which basically comprises a shift register into which the addresses are loaded in accordance with the computed delays provided by the computer 86. The reoriented addresses are then shifted out of the descrambler 84 through the segment select circuit 56 to control the retrieval of data from the memory 36. The outputs from the memories 36 and 38 are reconverted to linear signals by way of the decoders 40 and 42 and the two signals are summed in the adder 44 to produce the recovered, unscrambled speech signals, which are applied through the transmit and receive data multipleser 68 to the output terminal 2.

The random reversals which are applied in the scrambler are corrected for during the descrambling operation automatically in that a second reversal of the same segment addresses is effected under control of the low band and high band inverters 52 and 54 by the pseudorandom sequence generator 58. This is accomplished automatically since the same addresses will be generated by the generator 58 in the descrambling operation as were generated during the scrambling operation and the same identical outputs will be provided to the inverters 52 and 54 which caused the initial inversion of the segment addresses in effecting the scrambling of the speech signals.

Figure 3:
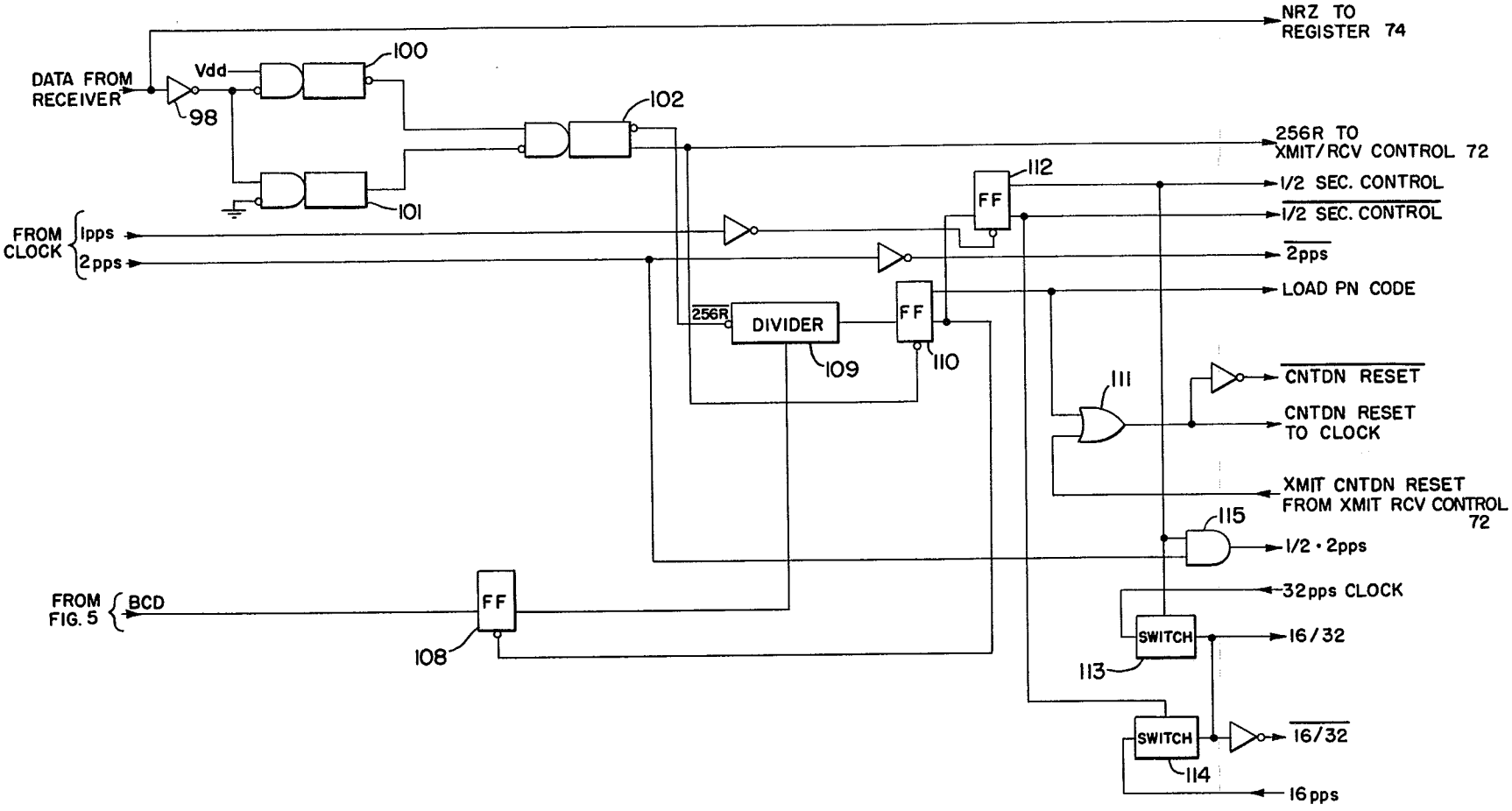
FIG. 3 is a schematic circuit diagram of the data recovery and sequence control circuits.
Figure 4A:
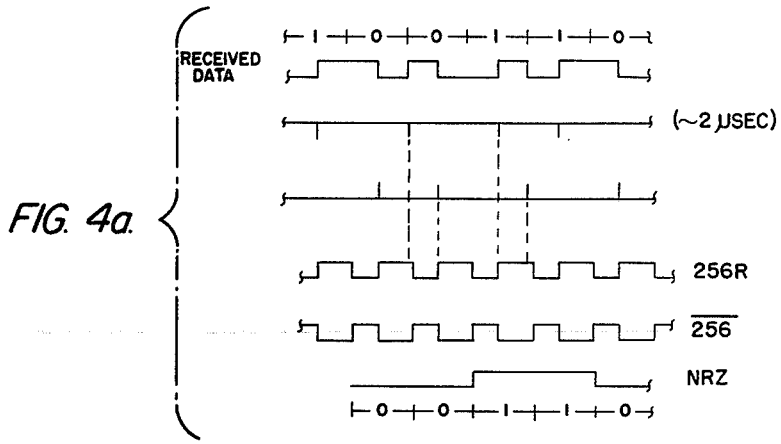
FIGS. 4*a*, 4*b*, 4*c*, 4*d* and 4*e* are waveform diagrams which aid in understanding the operation of the present invention.

Details of the data recovery circuit 70 and the sequence control circuit 64 are illustrated in FIG. 3. Data from the receiver is applied through inverter 98 to a pair of edge detecting circuits 100 and 101. The detecting circuit 100 detects the leading edges of the received data signals and the detecting circuit 101 detects the trailing edges of the received data signals, as seen in FIG. 4*a*. The outputs of the two detecting circuits are combined in clock generator circuit 102 to produce a realigned clock signal 256R applied to the transmit/-receive control 72. The received data is also applied directly onto line NRZ to the register 74, which receives and stores the synchronizing signal forming the preamble of the transmitted data. The Barker code pattern included in the synchronizing signal is forwarded from the register 74 to the detector 76, which is illustrated in more detail in FIG. 5. This detector comprises a plurality of AND gates 103 through 106 having inverters connected to selected inputs thereof so as to detect the 32 bit fixed pattern of the Barker code. When the code has been detected, each of the AND gates 103 through 106 will provide an output through OR gate 107 on line BCD, indicating detection of the Barker code.

Figure 4B:
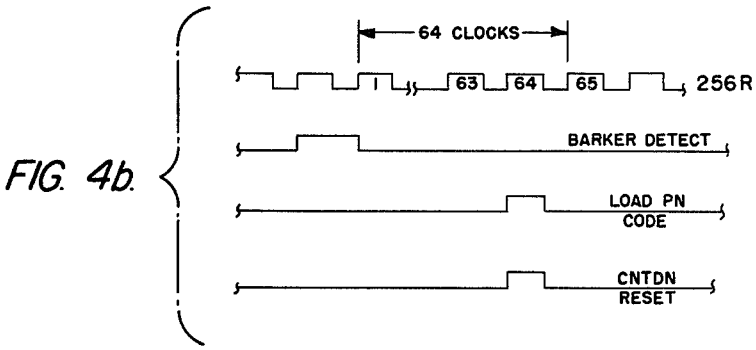
Figure 4C:
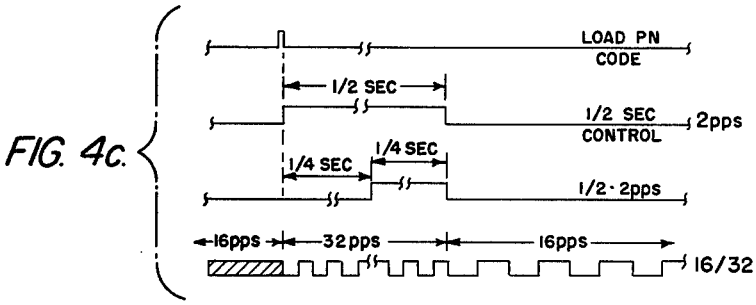

As seen in FIG. 3, enabling of the lead BCD upon detection of the Barker code will be received in flip-flop 108, the output of which enables a divider 109 connected to receive the realigned clock signal at the output of circuit 102. The realigned clock signal is divided by sixty-four to produce an output enabling flip-flop 110 at the time the register 74 has received all sixty-four bits included in the synchronizing signal representing the contents of the pseudorandom sequence generator in the system which has scrambled the received transmission. Setting of the flip-flop 110 produces the signal LOAD PN code which effects transfer of the sixty-four bits in the register 74 into the pseudorandom sequence generator 58. At the same time, gate 111 is enabled to generate a reset signal on lead CNTN RESET to reset the clock counter 46. Various timing signals are also generated by the circuits 112, 113, and 114 for control of the system timing in response to received clock signals, the generated signals being illustrated in FIGS. 4*b* and 4*c*.

Figure 6A:
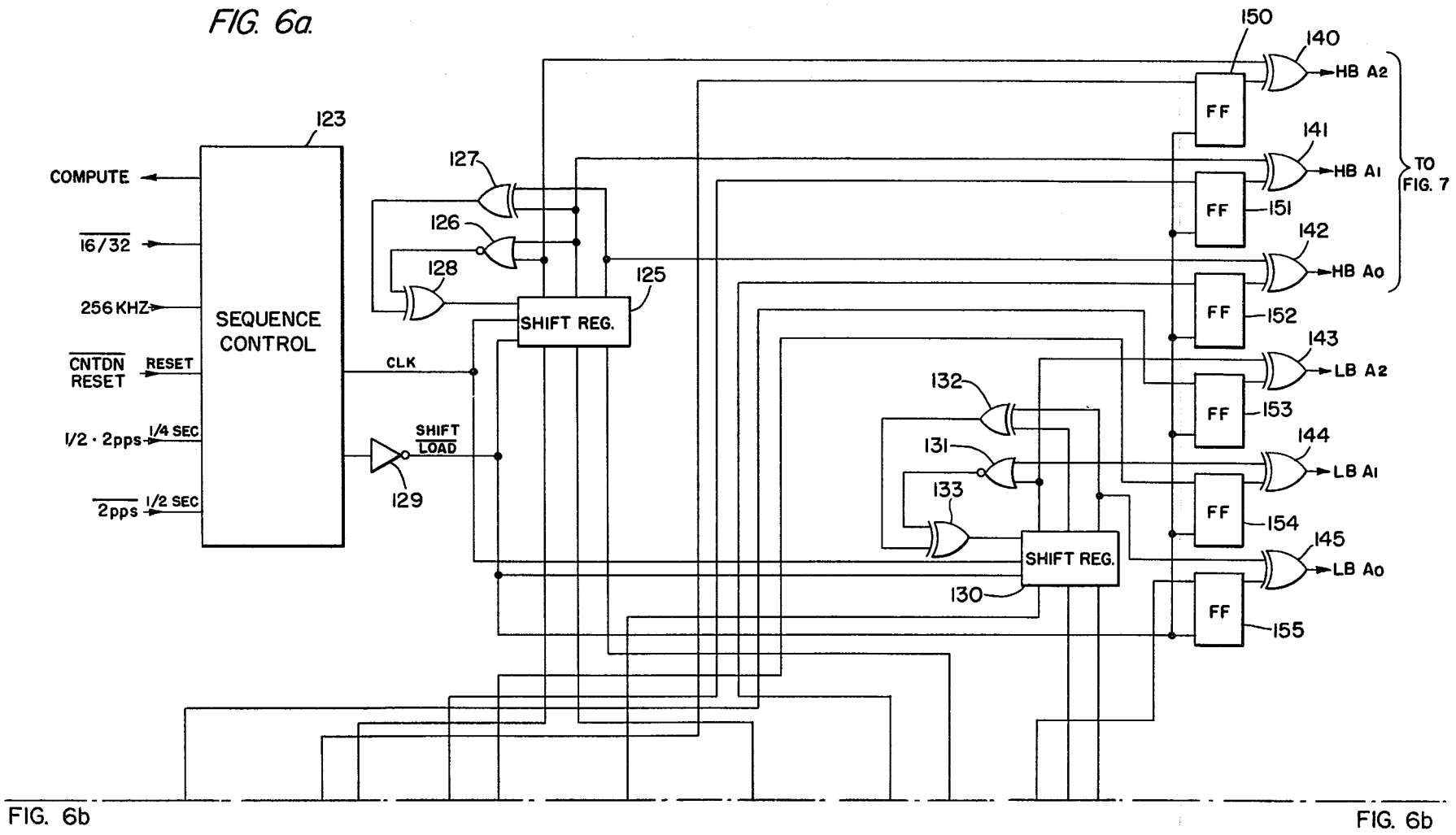
FIGS. 6*a* and 6*b*, when combined, are a schematic circuit diagram of the pseudorandom sequence generators.
Figure 6B:
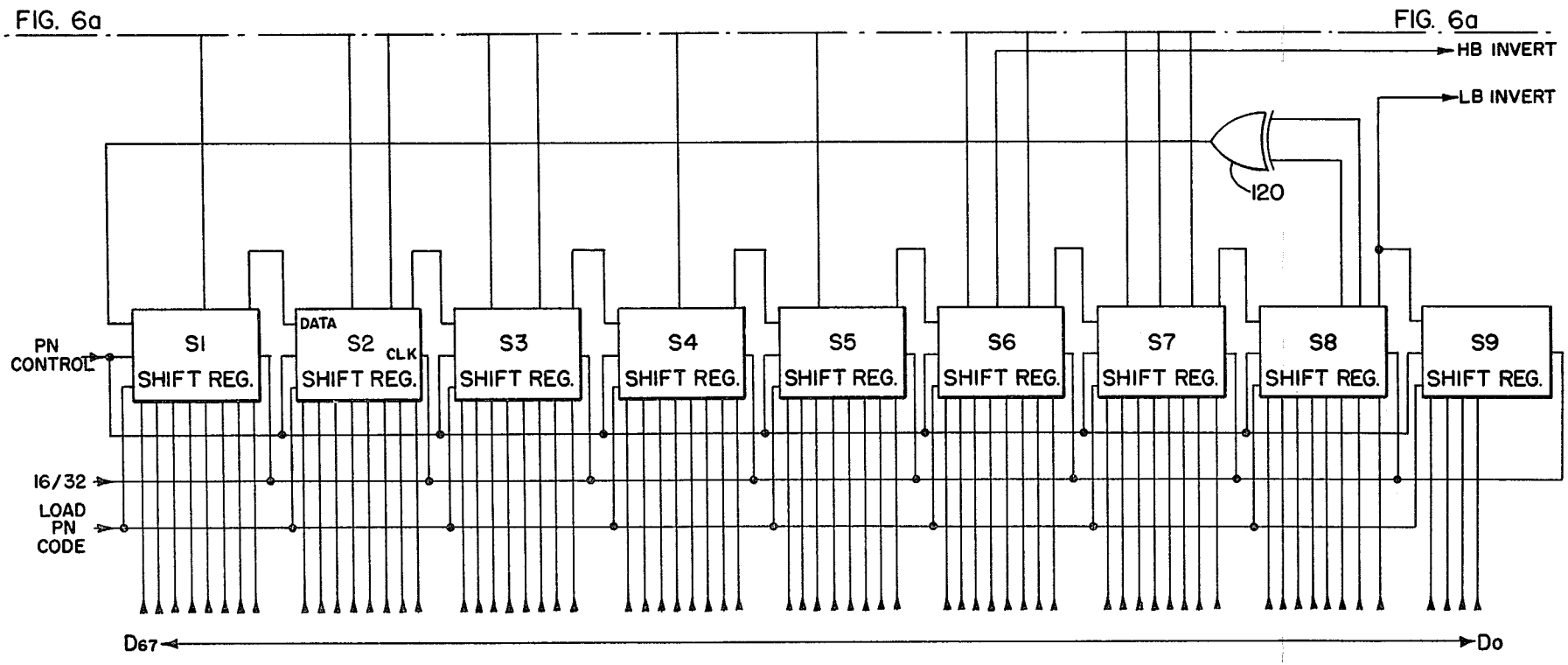

The details of the pseudorandom sequence generator 58, the high band pseudorandom sequence generator 60, and the low band pseudorandom sequence generator 62 are illustrated in FIG. 6*a* and 6*b*. The pseudorandom sequence generator 58 comprises nine shift register stages S1 through S9 with the output of the stages S8 being connected back through EXCLUSIVE OR gate 120 to the input of register S1. Each of the register stages S1 through S9 is capable of being parallel loaded with the contents of the register 74 upon receipt of the load PN code signal from the sequencer control 64, and the contents of the register stages are shifted in accordance with the clock signal 16/32 to generate a random digital bit stream at the rate of two bits per second.

Figure 4D:
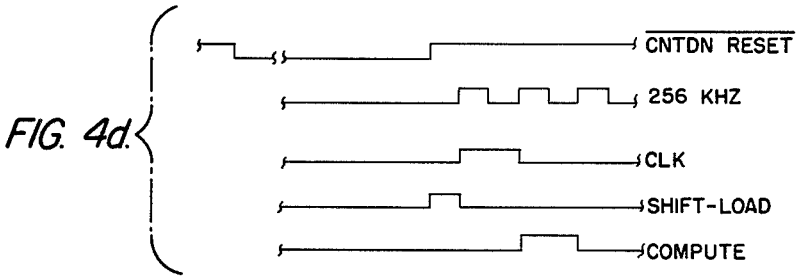

Selected outputs from stages S4, S5, and S6 are applied to three-stage shift register 125, while a selected output from register stage S4 and two selected outputs from register stage S7 are applied to three stage shift register 130, the register 125 and 130 being parallel loaded in response to the shift/load pulse received through inverter 129 from the sequence control circuit 123 (see FIG. 4*d*). The outputs of the shift register 125 are applied through OR gate 126 and EXCLUSIVE OR gates 127 and 128 to the input of the register; while, the outputs of the register 130 are applied through OR gate 131 and EXCLUSIVE OR gates 132 and 133 to the input of that register. Clock signals from the sequence control circuit 123 drive the register 125 and 130 to generate an eight bit sequence at sixteen bits per second, and the shift/load signal provided at the output of inverter 129 from the sequence control circuit 123 resets the registers 125 and 130 every one-half second to random patterns determined by the outputs of the selected stages of the pseudorandom sequence generator 58.

The outputs of the register 125 are applied to one input of respective EXCLUSIVE OR gates 140, 141, and 142; while, the outputs of the register 130 are applied to one input of the respective EXCLUSIVE OR gates 143, 144, and 145. To the other inputs of the EXCLUSIVE OR gates 140–145 there is applied selected outputs of the pseudorandom sequence generator 58 stored in flip-flops 150 through 155. Thus, the outputs of the registers 125 and 130 are further randomized by being mixed with the contents of the pseudorandom sequence generator 58, the net result being two pseudorandom sequences of three bit words, which randomly sequence through the full set of all eight possible states every one-half second. This successive randomizing of the addresses generated by the registers 125 and 130 provide substantially increased security in connection with the scrambling operation.

The outputs of the EXCLUSIVE OR gates 140 through 145 are supplied to the segment select circuit 56, a portion of which relating to the high band memory 36, is illustrated in FIG. 7. The segment select circuit 56 merely determines on the basis of the applied signal T/R whether the system is to operate in the transmit or receive mode. During the transmit mode, the segment addresses are derived from the sequencer circuits 60 and 62 and applied directly to the memories 36 and 38 via AND gates 155, 156, and 157 connected to OR gates 161–163. On the other hand, during the receive mode, the addresses generated by the sequencers 60 and 62 are first applied to the segment delay control circuits 77 and 87 for processing prior to being applied through AND gates 158–160 connected to OR gates 161–163 and the segment select circuit 56 to the memories 36 and 38. Thus, depending on the polarity of the signal T/R, either the addresses directly generated from the sequencer 60 and 62 will be selected, or the addresses provided by the segment delay control circuits 77 and 87 will be selected for controlling storage and retrieval of data in the memories 36 and 38.

The basic function of the segment delay control circuit 77 and 87 is to calculate the additional delay required for each segment to make the total delay equal for each segment through the scrambling and descrambling operations combined. This is accomplished on the basis of the segment addresses which are generated by the sequencers 60 and 62 from the state of the pseudorandom sequence generator 58, which is present from the contents of the sequence generator at the beginning of the scrambling operation, as obtained from part of the preamble of the scrambled transmission. This calculation of the additional delay required for each segment is performed by the delay computer 86 in the segment delay control circuits.

Figure 4E:
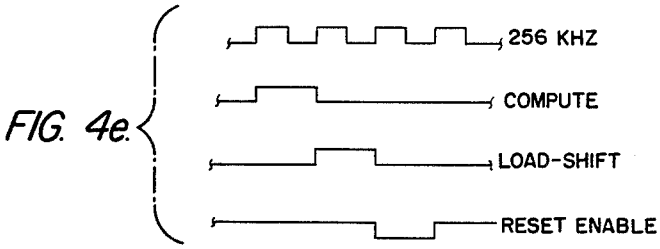
Figure 8:
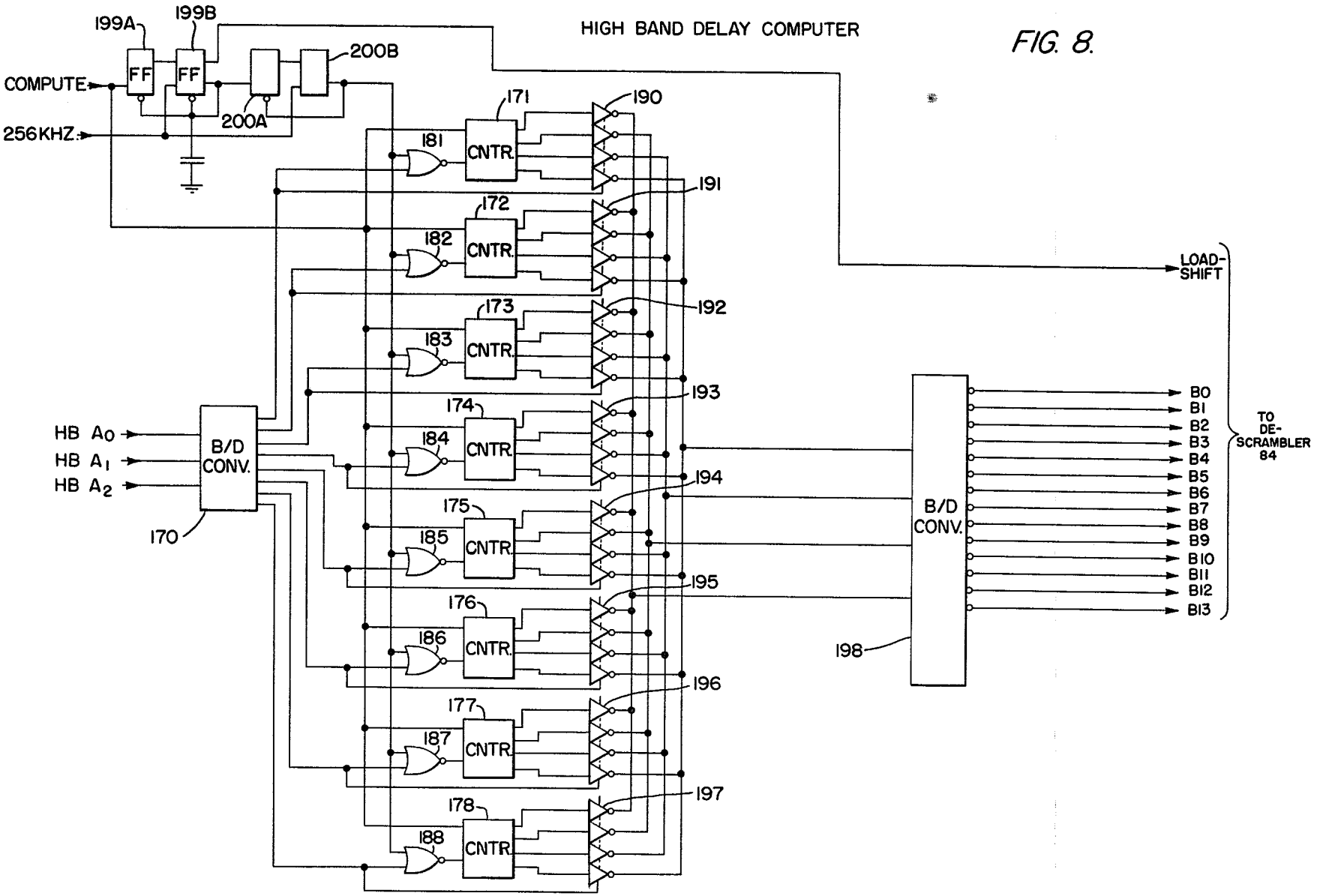
FIG. 8 is a schematic circuit diagram of the delay computer circuit.

The delay computer 86, which is illustrated in FIG. 8, includes a binary-to-decimal converter 170 which receives the segment addresses as they are generated by the sequencer 60 or 62 and enables one of the output leads thereof in response to each received address. Eight counters 171 through 178 are enabled by the signal COMPUTE obtained from the sequence control circuit 123 (FIG. 6*a*) and will count until they are reset by a respective output of the converter 170 via a corresponding OR gate 181 through 188. A timing circuit consisting of flip-flops 199A, 199B and 200A, 200B is responsive to the signal COMPUTE and the 256 KHz clock signal to provide a load/shift signal and reset enable signal, as seen in FIG. 4*e*. Each of the eight counters will be reset each time a segment address assigned to that counter is generated, and the contents of each counter, when reset, will represent the delay associated with the particular memory segment identified by the address.

At the beginning of the descrambling operation, the first sequence of eight segment addresses, which are derived from the sequencer state carried in the preamble of the transmission, will be applied to the converter 170 and will reset the counters 171 through 178 in the sequence in which the segments are to be stored in high band memory 36. The next sequence of eight addresses which are generated represents the address sequence used for data retrieval during the scrambling operation and these addresses are also applied to the converter 170. The counters 171 through 178 are again reset in accordance with this sequence of addresses and the contents of each counter, when reset, will represent the length of time since its address last appeared, thereby providing the scrambling delays.

The contents of each of the counters 171–178 representing the delays applied to the segments of data during the scrambling operation, are then inverted by a respective inverter combination 190–197, which produces the computed delay required to equalize the total delay to be applied to each segment for purposes of descrambling the data. As the computed delays are provided at the outputs of the inverter combinations 190–197, they are applied to a binary-to-decimal converter 198, the outputs B0–B13 of which represent the weighted delays to be applied to the respective segments, and these outputs are used to control the loading of the second sequence of segment addresses supplied from the output of the delay circuit 80 via delay address multiplexer 82 into a corresponding stage of the shift register provided in the descrambler circuit 84. After all addresses for the eight segments have been provided to the descrambler 84, these addresses will have been loaded in response to the load/shift signal (see FIG. 4*e*) at the output of flip-flop 199B into the shift register in the descrambler 84 in stages corresponding to the required delays to effect descrambling of the associated data segments. The addresses are then shifted out of the descrambler 84 in series to the segment select circuit 56 for effecting retrieval of the data from the memories 36 and 38.

The digital data retrieved from the two memories 36 and 38 represents the two speech bands of unscrambled speech in digital form. Each channel is then converted to linear signals by the decoders 40 and 42 and the two channels are then added and filtered by the adder 44 and applied through the multiplexer 68 to the output terminal 2.

It is apparent from the foregoing detailed description of an exemplary embodiment that the present invention provides for increased security in the scrambling of private data by separating the clear speech into high and low frequency channels and scrambling each channel separately prior to recombining the two scrambled portions to provide a composite scrambled speech signal. In addition, security is further enhanced by inverting random segments of the scrambled speech so as to thereby further complicate the scrambling function.

It also should be noted that the scrambling operation is effected by the coordinate action of a long pseudorandom sequence generator which generates a random digital bit stream in combination with two short random sequence generators which each generate an eight bit sequence of segment addresses each one-half second. In this regard, additional randomizing of the addresses is accomplished by mixing the outputs of the short sequence generators with the contents of the long sequence generator.

Descrambling of the data is also accomplished in accordance with the present invention in a simplified manner through the use of a delay computer in combination with a simple shift register into which is loaded at positions corresponding to the required delay for descrambling those addresses generated during the scrambling operation. Once the addresses are loaded in proper sequence to ensure descrambling of the stored data, the addresses need only be shifted out to the memory for retrieval of the data in its original form.

While I have shown and described an embodiment in accordance with the present invention, it is to be understood that the same is not limited thereto but is susceptible of numerous changes and modifications as are known to one of ordinary skill in the art and I therefore do not wish to be limited to the details shown and described herein but intend to cover all such changes and modifications as are obvious to those skilled in the art.

What is claimed is:

1. A privacy communication system in which segments of data are randomly shifted in time prior to transmission, comprising filter means for separating data signals into respective high frequency and low frequency channels;

encoder means, coupled to said filter means, for encoding the data signals in each channel into digital form;

first and second memory means connected to said filter means for storing said respective channels of data signals in segments of predetermined length;

first memory address means for generating address signals to address the storage locations in each segment of said first and second memory means for storage and retrieval of the data signals of each segment;

second memory address means for generating first and second random sequences of segment address signals to control the sequence of segment selection in said respective first and second memory means for storage and retrieval of data in random manner;

decoder means for decoding the data signals retrieved from said first and second memory means; and summing means, coupled to said decoder means, for adding the first and second channels of data signals retrieved from said first and second memory means prior to transmission.

2. A privacy communication system as defined in claim 1 wherein said first memory address means includes counter means for repetitively generating sequential addresses identifying the storage locations within each of the memory segments, memory control means for controlling said first and second memory means to read data out of said storage locations identified by said sequential addresses at the same time data is read into the same storage locations, and means for applying said sequential addresses to said first and second memory means.

3. A privacy communication system as defined in claim 2, further including first and second invert means responsive to respective invert signals for selectively inverting the order of the sequential addresses generated by said counter means which are to be applied to said respective first and second memory means.

4. A privacy communication system as defined in claim 3 wherein said respective invert signals are generated by said second memory address means.

5. A privacy communication system as defined in claim 1 wherein said second memory address means comprises a main multistage pseudorandom sequence generator, first and second multi-stage pseudorandom sequence generators having fewer stages than said main sequence generator, means connecting selective stages of said main sequence generator to said first and second sequence generators, and clock means for driving said first and second sequence generators to generate the addresses of said memory segments sequentially during repetitive time periods and for presetting said first and second sequence generators to the value designated by said selective stages of said main sequence generator for each of said repetitive time periods.

6. A privacy communication system as defined in claim 5 wherein said second memory address means further includes first and second address randomizer means for combining the outputs of said first and second sequence generators with further selected outputs of said main sequence generator to further randomize the segment addresses.

7. A privacy communication system as defined in claim 6 wherein said first and second address randomizer means each include a plurality of EXCLUSIVE OR gates receiving at their respective inputs the outputs of one of said first and second sequence generators and certain of said further selected outputs of said main sequence generator.

8. A privacy communication system as defined in claim 7 wherein said first memory address means includes counter means for repetitively generating sequential addresses identifying the storage locations within each of the memory segments, memory control means for controlling said first and second memory means to read data out of said storage locations identified by said sequential addresses at the same time data is read into the same storage locations, and means for applying said sequential addresses to said first and second memory means.

9. A privacy communication system as defined in claim 8, further including first and second invert means responsive to respective invert signals for selectively inverting the order of the sequential addresses generated by said counter means which are to be applied to said respective first and second memory means.

10. A privacy communication system as defined in claim 9 wherein said respective invert signals are derived from selected stages of said main sequence generator.

11. A privacy communication system as defined in claim 5, further including message preamble generating means for generating a synchronizing signal comprising a synchronizing code and the contents of said main sequence generator, and multiplexing means connected to said summing means and said message preamble generating means for inserting said synchronizing signal prior to the data retrieved from said first and second memory means.

12. A privacy communication system as defined in claim 11 wherein said message preamble generating means includes a multistage register and transmit/-receive control means responsive to a transmit instruction signal for loading into said multi-stage register said synchronizing code and the contents of said main sequence generator, the output of said register being connected to said multiplexing means.

13. A privacy communication system as defined in claim 5, further comprising multi-stage register means for storing a synchronizing signal forming the preamble of a received communication signal including a synchronizing code and a sequence control signal representing the state of the main sequence generator which control transmission of the received communication, transmit/receive control means responsive to a receive instruct signal for loading said synchronizing signal into said register means, and synchronizing code detecting means for presetting said main sequence generator in accordance with the sequence control signals stored in said register.

14. A privacy communication system as defined in claim 13 wherein said second memory address means further includes first and second address randomizer means for combining the outputs of said first and second sequence generators with further selected outputs of said main sequence generator to further randomize the segment addresses.

15. A privacy communication system as defined in claim 14, further comprising first and second descrambler control means responsive to the segment address signals generated by said first and second address randomizer means in effecting storage of a received communication in said first and second memory means for generating a rearranged sequence of said addresses in an order capable of descrambling that data when retrieved from said first and second memories.

16. A privacy communication system as defined in claim 15 further including segment address select means responsive to transmit and receive instruction signals for applying to said first and second memory means segment addresses derived from said first and second address randomizer means or said first and second descrambler control means, respectively.

17. A privacy communication system in which segments of data are randomly shifted in time to subject them to variable delays prior to transmission in the process of scrambling the communication, and in which scrambled segments of data in a received transmission are subjected to compensating delays to unscramble the data, comprising filter means for separating data signals into respective high frequency and low frequency channels;

encoder means for converting the data signals in each channel at the output of said filter means from analog to digital form;

first and second memory means for storing said respective channels of digital data signals in segments of predetermined length;

memory address generating means for generating first and second sequences of segment address signals in a random manner to control the sequence of segment selection in said respective first and second memory means for storage and retrieval of data with selected delays to effect scrambling and descrambling of said data;

decoder means for converting the data signals in each channel retrieved from said first and second memory means from digital to analog form; and summing means for adding the first and second channels of converted data signals provided by said decoder means;

and wherein said memory address generating means comprises a main multi-stage pseudorandom sequence generator, first and second multi-stage pseudorandom sequence generators having fewer stages than said main sequence generator, means connecting selective stages of said main sequence generator to said first and second sequence generators, and clock means for driving said first and second sequence generators to generate the addresses of said memory segments sequentially during repetitive time periods and for presetting said first and second sequence generators to the value designated by said selective stages of said main sequence generator for each of said repetitive time periods.

18. A privacy communication system as defined in claim 17, wherein said memory address generating means further includes first and second address randomizer means for combining the outputs of said first and second sequence generators with further selected outputs of said main sequence generator to further randomize the segment addresses.

19. A privacy communication system as defined in claim 18 wherein said first and second address randomizer means each include a plurality of EXCLUSIVE OR gates receiving at their respective inputs the outputs of one of said first and second sequence generators and certain of said further selected outputs of said main sequence generator.

20. A privacy communication system as defined in claim 18, further including means for generating a descrambling control signal comprising the contents of said main sequence generator at the beginning of a scrambling operation, and multiplexing means connected to said summing means for inserting said descrambling control signal into the transmitted signal prior to the data retrieved from said first and second memory means.

21. A privacy communication system as defined in claim 20, further including means responsive to a received communication signal for presetting said main sequence generator in accordance with a received descrambling control signal to thereby generate a sequence of segment addresses in accordance with the delays applied to the segments of data during the scrambling of said data.

22. A privacy communication system as defined in claim 21, further including first and second descrambler control means responsive to said sequence of segment addresses generated in response to said descrambling control signal by said main sequence generator for generating a rearranged sequence of segment addresses in which compensating delays are applied to said segment addresses to effect descrambling of the data stored in said first and second memory means.

23. A privacy communication system as defined in claim 22 further including segment address select means responsive to transmit and receive instruction signals for applying to said first and second memory means segment addresses derived from said first and second address randomizer means or said first and second descrambler control means, respectively.

24. A privacy communication system as defined in claim 22 wherein each of said first and second descrambler control means includes computer means responsive to said sequence of segment addresses generated in response to said descrambling control signal for calculating the delay required for each data segment to undergo an equal total delay during both the scrambling and descrambling operations and shift register means for storing the sequence of addresses generated by said main sequence generator in a rearranged order determined by said computer means.

25. A privacy communication system as defined in claim 24 wherein said computer means includes a plurality of counters each assigned to a respective segment address, means for driving said counters, means responsive to receipt of a segment address for resetting said counters, and means for determining the amount of delay to be applied to a segment in accordance with the state of said counter at the time of resetting.

26. A privacy communication system as defined in claim 22 wherein said memory address generating means includes counter means for repetitively generating sequential addresses identifying the storage locations within each of the memory segments, memory control means for controlling said first and second memory means to read data out of said storage locations identified by said sequential addresses at the same time data is read into the same storage locations, and means for applying said sequential addresses to said first and second memory means.

27. A privacy communication system as defined in claim 26, further including first and second invert means responsive to respective invert signals for selectively inverting the order of the sequential addresses generated by said counter means which are to be applied to said respective first and second memory means.

28. A privacy communication system as defined in claim 27 wherein said respective invert signals are derived from selected stages of said main sequence generator.

* * * * *